US007122729B2

(12) United States Patent
Lin

(10) Patent No.: US 7,122,729 B2
(45) Date of Patent: Oct. 17, 2006

(54) HARMONICA

(76) Inventor: Hsiu-Hsiung Lin, No. 63, Fu-Hsing St., Hua-Lian City, Hua-Lian Hsien (TW)

( * ) Notice: Subject to any disclaimer, the term of this patent is extended or adjusted under 35 U.S.C. 154(b) by 0 days.

(21) Appl. No.: 11/083,239

(22) Filed: Mar. 16, 2005

(65) Prior Publication Data

US 2006/0081113 A1 Apr. 20, 2006

(30) Foreign Application Priority Data

Oct. 20, 2004 (TW) ..... 93131808 A

(51) Int. Cl.
*G10D 7/00* (2006.01)

(52) U.S. Cl. ..... 84/377

(58) Field of Classification Search ..... 84/336, 84/377

See application file for complete search history.

(56) References Cited

U.S. PATENT DOCUMENTS 2,675,727 A 1/1952 Beker ..... 84/377
3,580,125 A * 5/1971 Heatwole ..... 84/377
3,674,910 A * 7/1972 McKenzie ..... 84/377
4,414,879 A * 11/1983 Ruiz ..... 84/379

FOREIGN PATENT DOCUMENTS

| | | |
|---|---|---|
| GB | 231094 A | 4/1925 |
| GB | 299801 A | 8/1929 |
| GB | 530804 A | 12/1940 |
| GB | 577352 A | 5/1946 |
| GB | 638921 A | 6/1950 |
| GB | 2 259 802 A | 3/1993 |

* cited by examiner

*Primary Examiner*—Kimberly Lockett
(74) *Attorney, Agent, or Firm*—Ladas & Parry LLP

(57) ABSTRACT

A harmonica includes a comb with a plurality of cell sets each including alternately arranged first and second cells, a plurality of mouthpieces registered with the cell sets, a reed vibrating member having a plurality of reeds registered with the cells and configured to be vibrated by an air flow for producing a tone of either one of diatonic and chromatic scales, and a valve member with a plurality of valve units interposed between the mouthpieces and the cell sets and shiftable between diatonic and chromatic positions to block the air flow into the second and first cells, respectively, thereby allowing the player to play the notes of both diatonic and chromatic scales.

9 Claims, 4 Drawing Sheets

HARMONICA

CROSS-REFERENCE TO RELATED APPLICATION

This application claims priority of Taiwanese Application No. 093131808, filed on Oct. 20, 2004.

BACKGROUND OF THE INVENTION

1. Field of the Invention

This invention relates to a harmonica, more particularly to a harmonica which can be used to play notes of diatonic and chromatic scales.

2. Description of the Related Art

A conventional 24-hole tremolo harmonica generally includes a comb sandwiched between two reed vibrating plates, which are in turn sandwiched between two covers. Each plate has a plurality of air holes respectively accommodating reeds such that the reeds are seated respectively inside cells formed within the comb. The cells allow air to flow into or out of the harmonica by the player's actions of blowing or drawing. Since the reeds on the plates are either blown or drawn, when played, so as to create a vibrating or tremolo effect, the pattern in the tremolo harmonica is the same as the diatonic major scale pattern in a diatonic harmonica, i.e. allowing the player to play the major scale of the keys. Although a skilled harmonica player can produce additional tones by a specific embouchure process, a problem with any musical instrument, including harmonicas, is that not all players are highly skilled at playing the instrument. Therefore, a chromatic harmonica is required to cooperate with the tremolo harmonica to produce most of tones for playing a whole song.

A harmonica assembly includes multiple harmonicas coupled to each other by a rotary shaft such that the player rotates the rotary shaft during playing for producing desired tones. However, the harmonica assembly is bulky and is inconvenient to operate.

SUMMARY OF THE INVENTION

The object of the present invention is to provide a harmonica which can be used to play notes of diatonic and chromatic scales and which can be played with relative ease.

According to this invention, the harmonica includes a comb having a central wall, a plurality of longitudinally displaced upper cell walls and a plurality of longitudinal displaced lower cell walls which extend upwardly and downwardly from upper and lower wall surfaces of the central wall, respectively, so as to define a plurality of alternately arranged first and second upper cells and a plurality of alternately arranged first and second lower cells. Two adjacent first and second upper cells and two adjacent first and second lower cells are formed as a cell set. A plurality of longitudinally displaced mouthpieces are disposed upstream or downstream of respective ones of the cell sets in terms of flow of blown air or drawn air, and are registered therewith. A reed vibrating member has a plurality of air passageways respectively disposed downstream or upstream of and registered with the cell sets, and a plurality of reeds disposed to be vibratile in the air passageways, respectively. When an air flow is introduced through the first upper and lower cells or the second upper and lower cells in a corresponding one of the cell sets into a corresponding one of the air passageways to thereby vibrate a corresponding one of the reeds, a note of either one of diatonic and chromatic scales is given out. An elongated valve member is disposed in the comb and is shiftable relative to the comb in the longitudinal direction between diatonic and chromatic positions, and includes a plurality of longitudinally displaced valve units which are interposed between the mouthpieces and the cell sets. In the diatonic position, each valve unit blocks the air flow from the respective mouthpiece into the second upper and lower cells of the corresponding cell set. In the chromatic position, each valve unit blocks the air flow from the respective mouthpiece into the first upper and lower cells of the corresponding cell set.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
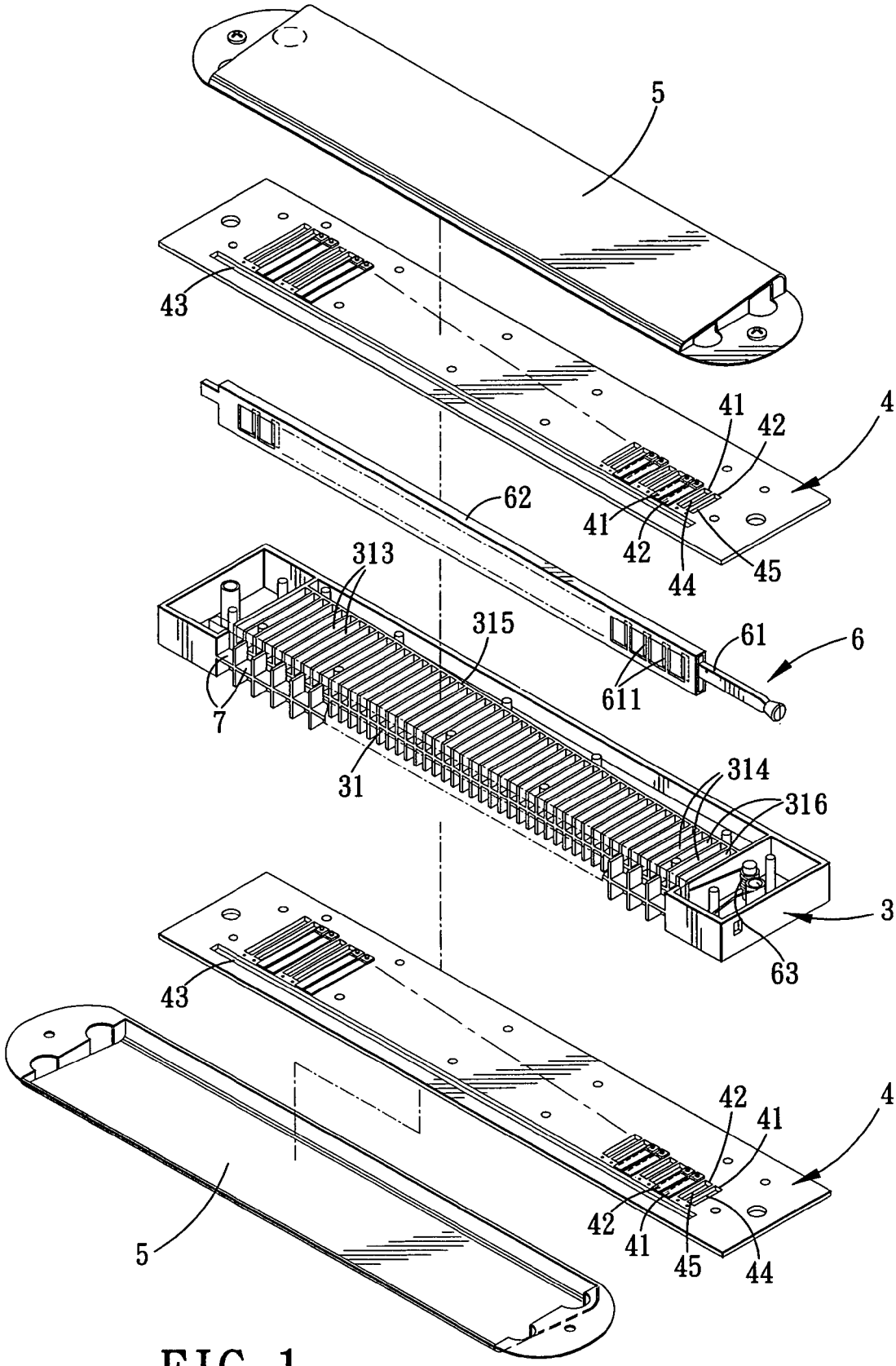
FIG. 1 is an exploded perspective view of the preferred embodiment of a harmonica according to this invention.
Figure 2:
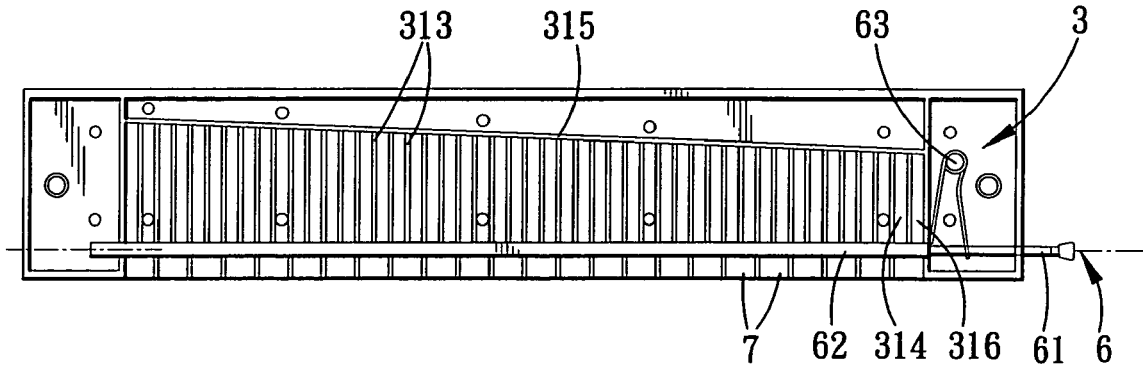
FIG. 2 is a schematic top view of the preferred embodiment, showing the relationship between mouthpieces and cell sets.
Figure 3:
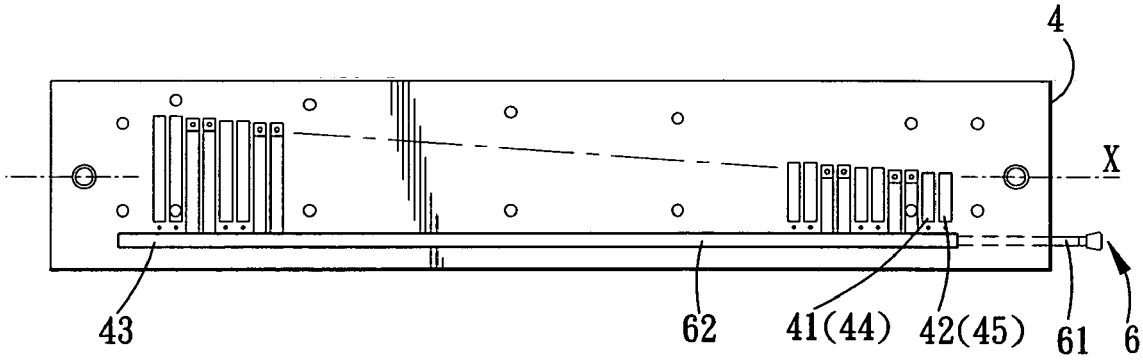
FIG. 3 is a schematic top view of the preferred embodiment, showing alternately arranged first and second reeds.

Referring to FIGS. 1 to 3, the preferred embodiment of a harmonica according to the present invention is shown to comprise a comb 3, a plurality of mouthpieces 7, a reed vibrating member, upper and lower covers 5, and an elongated valve member 6.

The comb 3 has a wedge-shaped central wall 31 with upper and lower wall surfaces, and a plurality of upper cell walls 313 which extend upwardly from the upper wall surface and which are displaced from one another in a longitudinal direction so as to define a plurality of first upper cells 314 and a plurality of second upper cells 316. The first upper cells 314 and the second upper cells 316 are arranged alternately in the longitudinal direction. A plurality of lower cell walls 313 extend downwardly from the lower wall surface of the central wall 31, and are displaced from one another in the longitudinal direction so as to define a plurality of first lower cells 314 and a plurality of second lower cells 316. The first lower cells 314 and the second lower cells 316 are arranged alternately in the longitudinal direction. The first and second upper cells 314, 316 are registered with the first and second lower cells 314, 316, respectively. Two adjacent first and second upper cells 314, 316 cooperate with two corresponding ones of the first and second lower cells 314, 316 to form a cell set. Each of the upper and lower cell walls 313 is trapezoidal in shape. A rear wall 315 is disposed to interconnect the cell walls 313.

The mouthpieces 7 are displaced from one another in the longitudinal direction, are integrally formed with the comb 3, and are spaced apart from and are disposed in front of the upper and lower cell walls 313 in a first transverse direction relative to the longitudinal direction. Each mouthpiece 7 is disposed upstream or downstream of a corresponding one of the cell sets in the first transverse direction in terms of flow of exhaled air or inhaled air, and is registered with the corresponding one of the cell sets.

The reed vibrating member includes an elongated upper reed vibrating plate 4 which is disposed above the upper cell wall 313, and an elongated lower reed vibrating plate 4 which is disposed under the lower cell wall 313. Each of the upper and lower reed vibrating plates 4 has first and second air holes 44, 45 which are displaced from one another in the longitudinal direction. The first and second air holes 44, 45 in the upper and lower reed vibrating plates 4 are registered with the first and second upper cells 314, 316 and the first and second lower cells 314, 316, respectively, in a second transverse direction relative to the longitudinal and first transverse directions, to serve as a plurality of air passageways upstream and downstream of the corresponding cell sets, respectively. The upper and lower reed vibrating plates 4 respectively have elongated upper and lower retaining slots 43 formed forwardly of the air holes 44, 45.

The reed vibrating member further includes a plurality of sets of first and second reeds 41, 42. Each of the first and second reeds 41, 42 has an end pivotally mounted on a respective one of the upper and lower reed vibrating plates 4 proximate to a respective one of the first and second air holes 44, 45, and an opposite end vibratile in the respective one of the first and second air holes 44, 45. Thus, when an air flow is introduced through the first upper and lower cells 314 or the second upper and lower cells 316 in one of the cell sets into the corresponding air passageway to thereby vibrate corresponding ones of the reeds 41, 42, a note of either one of diatonic and chromatic scales is given out. Specifically, when one first reed 41 is tuned to a note of C, the adjacent second reed 42 in the same cell set can be tuned to a note of C#. Therefore, for those first reeds 41 that are tuned to notes of E and B, the second reeds 42 as well as the corresponding second air holes 45, are not necessary.

The upper and lower covers 5 are disposed above and behind of the upper and lower reed plates 4, respectively, so as to protect the reed vibrating member and so as to form upper and lower resonating chambers 51 (see FIG. 4) that act as a resonator for the first and second reeds 41, 42.

Figure 4:
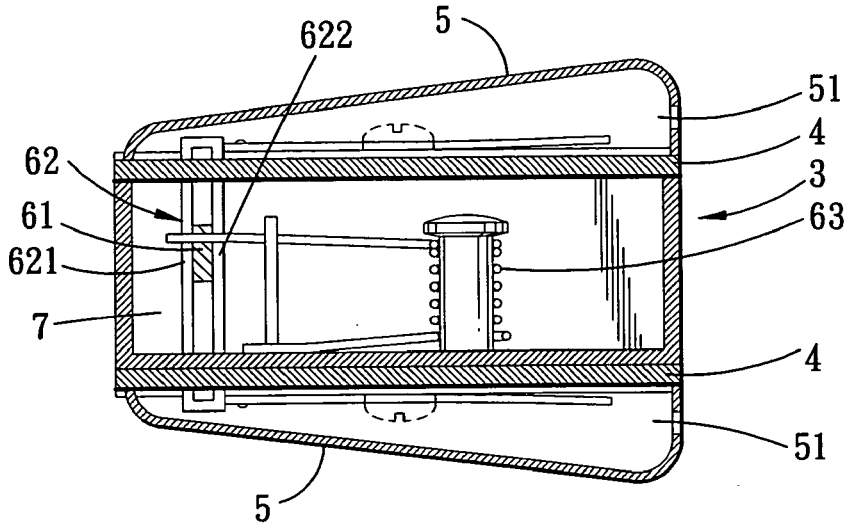
FIG. 4 is a sectional view of the preferred embodiment.
Figure 5:
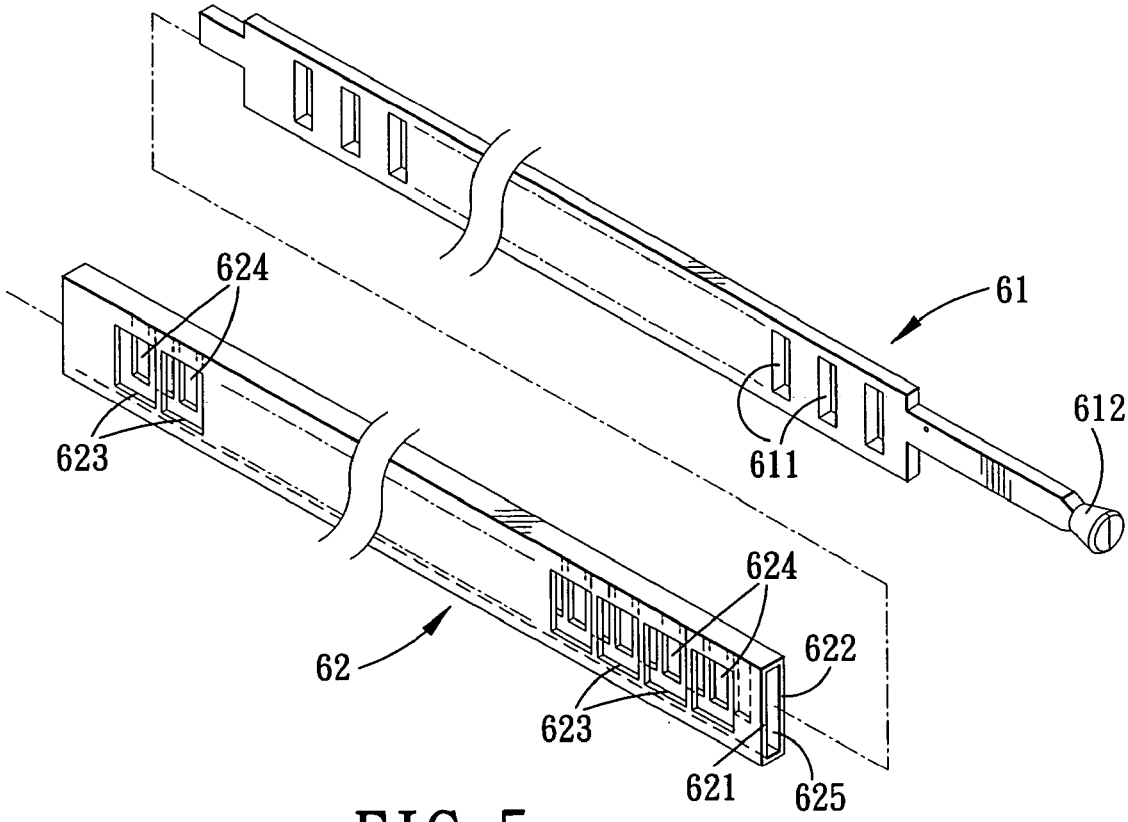
FIG. 5 is a fragmentary exploded perspective view of a valve member of the preferred embodiment.

With further reference to FIGS. 4 and 5, the valve member 6 has a hollow mounting shell 62 and an elongated valve plate 61 extending in the longitudinal direction. The mounting shell 62 is secured to the comb 3, is interposed between the mouthpieces 7 and the cell sets, and is retained in the upper and lower retaining slots 43. The mounting shell 62 includes a front wall 621 and a rear wall 622 which are proximate to the mouthpieces 7 and the cell sets respectively to confine a guiding groove 625 therebetween, and which respectively have front holes 623 and rear holes 624. The front holes 623 correspond to and are registered with the mouthpieces 7. Each of the rear holes 624 corresponds to and is registered with the first or second upper and lower cells 314, 316. The valve plate 61 is received in and is guided by the guiding groove 625 for movement relative to the mounting shell 62 in the longitudinal direction, and has a plurality of valve holes 611 that are displaced from one another in the longitudinal direction to serve as a plurality of valve units. A grip 612 is connected to the valve plate 61 to facilitate manipulation of the valve plate 61 by the player. It is noted that, alternatively, two grips 612 can be connected to left and right sides of the valve plate 61, rendering the harmonica of this invention suitable for use by both left-handed and right-handed players.

Figure 6:
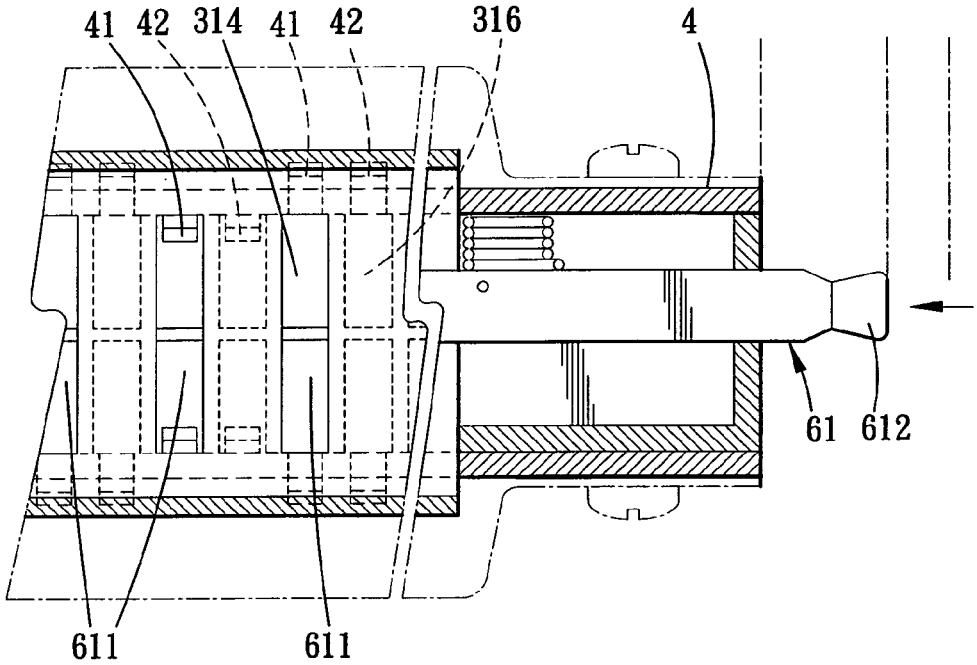
FIG. 6 is a fragmentary sectional view of the preferred embodiment, showing a valve plate in a diatonic position.
Figure 7:
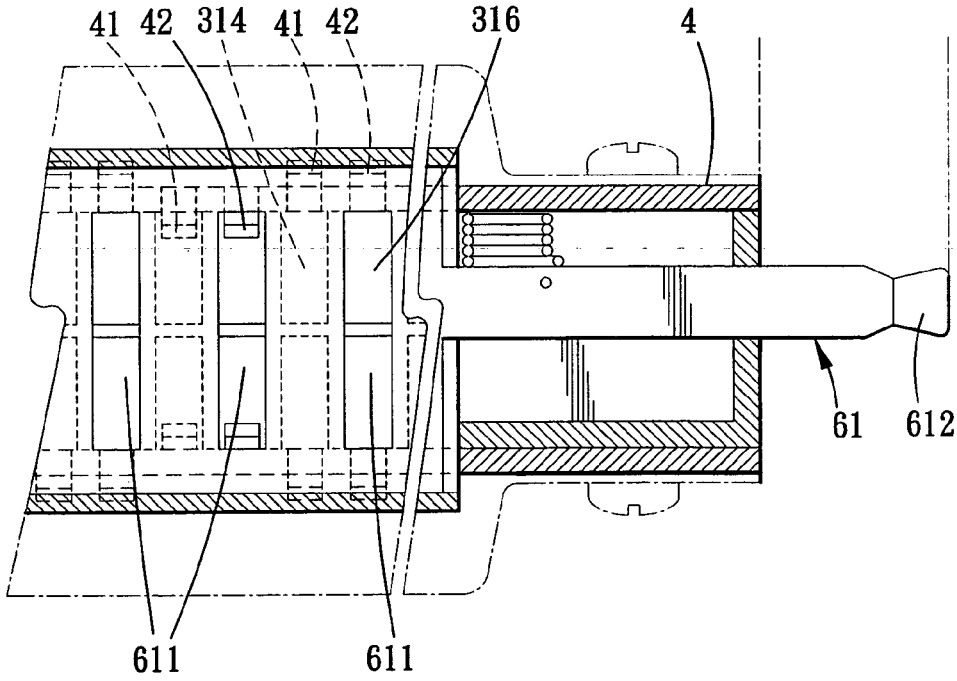
FIG. 7 is a fragmentary sectional view of the preferred embodiment, showing the valve plate in a chromatic position.

With reference to FIGS. 1, 6 and 7, the valve holes 611 in the valve plate 61 are configured such that, when the valve plate 61 is shifted to a diatonic position, as shown in FIG. 6, each of the valve holes 611 is registered with the first upper and lower cells 314 of a respective one of the cell sets so as to permit vibration of a respective one of the first reeds 41 in a corresponding one of the first air holes 44 by a flow of blown or drawn air for giving out a note of diatonic scale, while the valve plate 61 blocks the air flow from a respective one of the mouthpieces 7 into the second upper and lower cells 316 of the same cell set. When the valve plate 61 is shifted to a chromatic position, as shown in FIG. 7, each of the valve holes 611 is registered with the second upper and lower cells 316 of a respective one of the cell sets so as to permit vibration of a respective one of the second reeds 42 in a corresponding one of the second air holes 45 by a flow of blown or drawn air for giving out a note of chromatic scale, while the valve plate 61 blocks the air flow from the respective one of the mouthpieces 7 into the first upper and lower cells 314 of the same cell set. Furthermore, a biasing member 63, such as a coiled spring, is disposed between the valve plate 61 and the comb 3 to bias the valve plate 61 to the diatonic position.

As illustrated, the harmonica of this invention is ordinarily used to play all the diatonic tones. When it is desired to play a chromatic tone, i.e. a half-pitch tone, the player can operate the grip 612 to move the valve plate 61 against the force of the biasing member 63 to the chromatic position so that air can be blown or drawn through the respective mouthpiece 7 to vibrate the corresponding second reeds 42 to thereby produce a desired chromatic tone. The grip 612 can then be released to return the valve plate 61 to the diatonic position. Thus, the harmonica of this invention can be easily played and can enable a player of ordinary skill to play any desired diatonic and chromatic tones without problem. Besides, the harmonica of this invention is substantially the same as the conventional tremolo harmonica in terms of the blowing and drawing sequences and the number of mouthpieces 7, which makes the playing of the harmonica relatively easy.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A harmonica comprising:

a comb having a central wall with upper and lower wall surfaces, a plurality of upper cell walls which extend upwardly from said upper wall surface and which are displaced from one another in a longitudinal direction so as to define a plurality of first upper cells and a plurality of second upper cells, said first upper cells and said second upper cells being arranged alternately in the longitudinal direction, and a plurality of lower cell walls which extend downwardly from said lower wall surface and which are displaced from one another in the longitudinal direction so as to define a plurality of first lower cells and a plurality of second lower cells, said first lower cells and said second lower cells being arranged alternately in the longitudinal direction, said first and second upper cells being registered with said first and second lower cells, respectively, two adjacent ones of said first upper cells and said second upper cells and two corresponding ones of said first lower cells and second lower cells being formed as a cell set;

a plurality of mouthpieces displaced from one another in the longitudinal direction, each of said mouthpieces being disposed upstream or downstream of a corresponding one of said cell sets in a first transverse direction relative to the longitudinal direction in terms of flow of blown air or drawn air, and being registered with the corresponding one of said cell sets;

a reed vibrating member which has a plurality of air passageways, each of which is disposed downstream or upstream of and is registered with a corresponding one of said cell sets in a second transverse direction relative to the longitudinal and first transverse directions, and a plurality of reeds disposed to be vibratile in said air passageways, respectively, such that when an air flow is introduced through said first upper and lower cells or said second upper and lower cells in a corresponding one of said cell sets into a corresponding one of said air passageways to thereby vibrate a corresponding one of said reeds, a note of either one of diatonic and chromatic scales is given out; and an elongated valve member which extends in the longitudinal direction, which is disposed in said comb, and which is shiftable relative to said comb in the longitudinal direction between diatonic and chromatic positions, said elongated valve member including a plurality of valve units which are displaced from one another in the longitudinal direction, and which are interposed between said mouthpieces and said cell sets, such that, in the diatonic position, each of said valve units blocks the air flow from a respective one of said mouthpieces into said second upper and lower cells of a corresponding one of said cell sets, and such that, in the chromatic position, each of said valve units blocks the air flow from the respective one of said mouthpieces into said first upper and lower cells of the corresponding one of said cell sets.

2. The harmonica of claim 1, wherein said reed vibrating member includes elongated upper and lower reed vibrating plates which are disposed above and below said upper cell walls and said lower cell walls, respectively, each of said upper and lower reed vibrating plates having first and second air holes which are displaced from one another in the longitudinal direction, and which are registered with said first and second upper cells, respectively, to serve as said air passageways, each of said reeds having an end which is pivotally mounted on a respective one of said upper and lower reed vibrating plates proximate to a respective one of said first and second air holes, and an opposite end which is vibratile in the respective one of said first and second air holes.

3. The harmonica of claim 2, wherein said valve member includes an elongated valve plate which is disposed between said mouthpieces and said cell sets, and which has a plurality of valve holes that are displaced from one another in the longitudinal direction to serve as valve units, said valve holes being configured such that, in the diatonic position, each of said valve holes is registered with said first upper and lower cells of a respective one of said cell sets so as to permit vibration of a respective one of said reeds in a corresponding one of said first air holes by air flow for giving out a note of diatonic scale, and such that, in the chromatic position, each of said valve holes is registered with said second upper and lower cells of a respective one of said cell sets so as to permit vibration of a respective one of said reeds in a corresponding one of said second air holes by air flow for giving out a note of chromatic scale.

4. The harmonica of claim 3, further comprising a grip which is connected to said valve plate to facilitate shifting of said valve plate between the diatonic and chromatic positions.

5. The harmonic of claim 4, further comprising a biasing member disposed to bias said valve plate to the diatonic position.

6. The harmonica of claim 5, wherein said biasing member is a coiled spring which is disposed between said valve plate and said comb.

7. The harmonic of claim 2, further comprising a mounting shell which is secured to said comb and which is interposed between said mouthpieces and said cell sets, and which includes a front wall and a rear wall that are respectively proximate to said mouthpieces and said cell sets, that confine a guiding groove therebetween, and that respectively have front holes and rear holes, said front holes corresponding to and being registered with said mouthpieces, said rear holes corresponding to and being registered with said first and second upper and lower cells, said guiding groove being configured for guiding movement of said valve plate in the longitudinal direction.

8. The harmonica of claim 7, wherein said upper and lower reed vibrating plates respectively have elongated upper and lower retaining slots formed forwardly of said first and second air holes so as to retain said mounting shell therebetween.

9. The harmonica of claim 2, further comprising upper and lower covers disposed above and below said upper and lower reed plates, respectively, so as to protect said reed vibrating member and to act as a resonator for said reeds.

* * * * *